United States Patent [19]

Miyashita et al.

[11] Patent Number: 4,622,485

[45] Date of Patent: Nov. 11, 1986

[54] DISCHARGE LAMP WITH NEON GAS IN OUTER TUBE

[75] Inventors: Tsune Miyashita, Tokyo; Makoto Yasuda; Seiichi Murayama, both of Kokubunji; Yoji Arai, Katsuta, all of Japan

[73] Assignee: Hitachi, Ltd., Tokyo, Japan

[21] Appl. No.: 699,687

[22] Filed: Feb. 11, 1985

[30] Foreign Application Priority Data

Feb. 14, 1984 [JP] Japan ..... 59-24323

[51] Int. Cl.[4] ..... H01J 61/30; H01J 61/16

[52] U.S. Cl. ..... 313/25; 313/572; 313/643

[58] Field of Search ..... 313/25, 572, 643

[56] References Cited

U.S. PATENT DOCUMENTS 2,176,134 10/1939 Holst ..... 313/25

3,753,018 8/1973 Beijer et al. ..... 313/25

*Primary Examiner*—Palmer C. DeMeo

*Attorney, Agent, or Firm*—Antonelli, Terry & Wands

[57] ABSTRACT

A discharge lamp comprising an inner arc tube and an outer tube enclosing the inner tube. The outer tube is filled with neon at a pressure of 0.1 atm or more, or a gas mixture of neon in 80 pressure percent or more and breakdown suppressing gas.

10 Claims, 2 Drawing Figures

DISCHARGE LAMP WITH NEON GAS IN OUTER TUBE

BACKGROUND OF THE INVENTION

The present invention relates to a discharge lamp having an inner arc tube and outer jacket, and particularly to a discharge lamp designed to operate at a high tube loading.

For the ultraviolet light source of apparatus for physics and chemistry, for example a fluorescence detector in a liquid chromatograph, there have been used conventionally deuterium lamps or xenon short-arc lamps. The detection limit of these apparatus is dependent on the radiance of the light source, and the analysis of an extremely small amount of material needs a high radiant light source operable stably for continuous discharging. Deuterium lamps of around 30 watts are commonly used, but their ultraviolet radiance is not high enough for the analysis of an extremely small amount of material. Although large power deuterium lamps are available to cope with this matter, they have drawbacks such as the bulkiness due to their increased power dissipation and the need of water-cooled structure. Xenon short-arc lamps provide a high ultraviolet radiance, but have shortcomings such as a poor stability of intensity and a short work life of around 150 hours.

An alternative high radiance ultraviolet light source is the metal halide lamp filled with tantalum halide (disclosed in Japanese Patent Application Laid-Open No. 52-45391 filed on Apr. 9, 1977). However, the metal halide lamp designed for this high loading purpose operates at a tube temperature as high as 1000° C., that causes a swell of the arc tube in the operation if any little impurity is included within the tube during the fabricating process or if the electrode has any small bend.

SUMMARY OF THE INVENTION

An object of this invention is to provide a discharge lamp having an inner arc tube and outer jacket, which provides a high radiant power and is reliable in operation.

In order to achieve the above objectives, the inventive discharge lamp comprises an inner tube and an outer tube enclosing the inner tube, wherein the outer tube is filled with neon or gas mixture of neon in 80 pressure percent or more and breakdown suppressing gas at a pressure of 0.1 atm or more so as to suppress the rising temperature of the inner tube and also to prevent discharging in the outer tube.

DESCRIPTION OF THE PREFERRED EMBODIMENT

Figure 1:
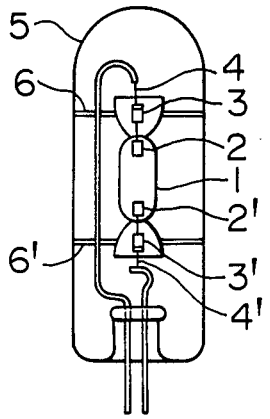
FIG. 1 is a cross-sectional view of the discharge lamp embodying the present invention.

An embodiment of the present invention will now be described with reference to the drawings. The high-radiance ultraviolet ray discharge lamp shown in FIG. 1 has an inner arc tube 1 which is formed of hydroxyl ion-free (fused) quartz in a thickness of 1.7 mm and an internal radius of 4 mm, and is transparent for ultraviolet rays. A pair of main electrodes 2 and 2' made of tungsten are sealed with a spacing of 10 mm from each other at the top and bottom of the arc tube 1, and these electrodes 2 and 2' are connected through molybdenum foils 3 and 3' to molybdenum lead wires 4 and 4', respectively. The arc tube 1 is filled with mercury, tantalum iodide, and xenon as starting rare gas, and it is secured with bands 6 and 6' inside an outer tube 5, at least part of which transmits ultraviolet rays.

The temperature of the wall of the arc tube 1 was measured by operating the lamp with the outer tube 5 filled with various kinds of gas. The measurement results are listed in Table 1, in which the gas pressure is the value at the room temperature.

TABLE 1

| Gas filled in outer tube (Pressure) | Temperature of arc tube |
|---|---|
| Vacuum | 1010° C. |
| Nitrogen (0.1-1 atm) | 970° C. |
| Argon (0.1-1 atm) | 980° C. |
| Carbon dioxide (0.1-1 atm) | 970° C. |
| Neon (0.1-1 atm) | 900° C. |
| Neon (90%) plus nitrogen (10%) (0.1-1 atm) | 910° C. |
| Neon (90%) plus carbon dioxide (10%) (0.1-1 atm) | 910° C. |
| Neon (90%) plus sulfur hexafluoride (10%) (0.1-1 atm) | 910° C. |

When the outer tube 5 is filled with gas other than neon, the wall temperature of the arc tube 1 is approximately 970° C. for a 60-watt lamp input. Although the temperature is slightly lower than the case of vacuum, the effect of the gas on cooling the arc tube 1 is little. When the outer tube 5 is filled with neon or gas mixture including neon as a main component, the wall temperature of the arc tube 1 is approximately 910° C., that is about 10% lower than the case of vacuum, and the cooling effect is enhanced. The cooling effect of neon is based on its higher thermal conductivity, and the effect of gas pressure on cooling the arc tube 1 was found unchanged in the range of 0.1-1 atm. Other high thermal conductivity gases known are hydrogen and helium. Hydrogen is disadvantageous for this purpose due to its extremely high permeability from the outer tube 5 into the arc tube 1, resulting in a higher lamp starting voltage. Helium is difficult to be kept inside the tube due to its high diffusibility, and cannot be used for this purpose. In the case of neon, the gas pressure must be at least 0.1 atm, since low-pressure neon filled in the outer tube 5 is apt to cause discharging between the lead wires 4 and 4'.

Figure 2:
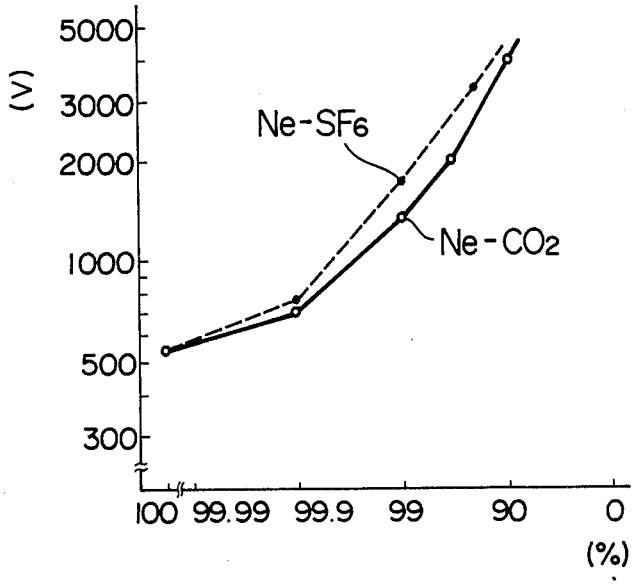
FIG. 2 is a graph showing the relationship between the neon partial pressure of gas mixture filled in the outer tube of the above discharge lamp and its breakdown voltage.

FIG. 2 shows the results of measurement of the breakdown voltage between the lead wires 4 and 4' with a spacing of 4 mm in the structure of FIG. 1, with the outer tube 5 filled with gas mixtures of neon and carbon dioxide, and neon and sulfur hexafluoride in various mixing ratio. It is apparent from the graph that the outer tube filled with the gas mixture provides the enhanced breakdown voltage as compared with the case of outer tube filled with pure neon, i.e., carbon dioxide and hexafluoride act as breakdown suppressing gas. In the case of the neon carbon dioxide mixture, addition of a small amount of carbon monoxide to the mixture is effective for protecting the lead wires from oxidation. Other breakdown suppressing gases available are nitrogen, fluorocarbon and fluoro-chlorocarbon.

The breakdown voltage between the lead wires 4 and 4' must be higher than the starting voltage of the discharge lamp, and at least 1000 volts is generally required. Low-voltage starting discharge lamps having an arc tube filled with gas mixture of neon and argon or provided with a starting electrode operate at a starting voltage below 200 volts, and in these cases the breakdown voltage of the lead wire must be above 200 volts. The breakdown voltage of 200 volts is achieved when the outer tube is filled with neon at 50 Torr, and the breakdown voltage is increased to 240 volts and 300 volts when the neon pressure is increased to 100 Torr and 200 Torr, respectively. Accordingly, the breakdown voltage can readily be brought to a level higher than the starting voltage by filling the outer tube with neon at approximately 0.1 atm. Discharge lamps other than the above-mentioned low-voltage starting discharge lamps, particularly a high-radiance discharge lamp such as that embodying the present invention need to contain breakdown suppressing gas of 0.1 pressure percent or more at which the breakdown suppressing effect appears significantly as shown in FIG. 2 in consideration of a safety margin for the disparity of starting voltage of individual lamps. More preferably, the outer tube is filled with the breakdown suppressing gas at 1 pressure percent or more so as to ensure the effect of breakdown suppression.

The measurement results similar to those shown in FIG. 2 were obtained for gas mixtures based by neon with an additive of nitrogen, fluorocarbon or fluorochlorocarbon. The breakdown suppressing gas added to neon in excess of 20 pressure percent causes the gas mixture to have a lower thermal conductivity, resulting in an impaired cooling effect for the arc tube 1, and on this account the breakdown suppressing gas must be below 20 pressure percent. The gas mixture including the breakdown suppressing gas below 10 pressure percent has a cooling effect similar to the case of pure neon as shown in Table 1.

By filling neon in the outer tube 5 of the discharge lamp, the wall temperature of the arc tube 1 can be suppressed from rising, and by adding breakdown suppressing gas in 0.1–20 pressure percent to neon, the breakdown voltage between the lead wires 4 and 4' can be increased, whereby the radiance of the discharge lamp can be enhanced and swelling of arc tube 1 and discharging in the outer tube 5 can be prevented. By adding the breakdown suppressing gas in 1 pressure percent or more to neon, discharging between the lead wires 4 and 4' within the outer tube 5 can surely be prevented, and by increasing the proportion of the breakdown suppressing gas up to 10 pressure percent, the wall temperature of the arc tube can be lowered to a level comparable to the case of pure neon filled in the outer tube. In conclusion, it is most desirable to add the breakdown suppressing gas in a proportion ranging from 1 to 10 pressure percent to neon.

Although in the foregoing embodiment a metal halide lamp as a high-radiance ultraviolet ray discharge lamp has been described, mercury lamps, high pressure sodium lamps and small fluorescent lamps with an inner arc tube and outer tube can also be rendered the cooling effect for the arc tube by provision of the outer tube filled with neon at 0.1 atm or more, or the gas mixture of neon in 80 pressure percent or more and breakdown suppressing gas, whereby discharge lamps of the above-mentioned kinds can made compact and more radiant, and discharging in the outer tube can be prevented.

As described above, the inventive discharge lamp consists of an inner arc tube and an outer tube which is filled with neon at 0.1 atm or more, or a gas mixture of neon in 80 pressure percent or more and the discharge suppressing gas, that is effective for suppressing the temperature rise on the inner tube and enhancing the lamp loading, and also effective for preventing the inner tube from swelling in the operation and preventing discharging in the outer tube, whereby a compact, high radiance and reliable discharge lamp can be achieved.

We claim:

1. A discharge lamp comprising an inner tube and an outer tube enclosing said inner tube, wherein said outer tube is filled with neon gas only at a pressure of 0.1 atm or more, or a gas mixture of neon in 80 pressure percent or more and a breakdown suppressing gas, so as to suppress any rise in temperature of the inner tube during operation of the lamp while preventing discharge in the outer tube.

2. A discharge lamp according to claim 1, wherein said breakdown suppressing gas comprises in a range of 0.1–20 pressure percent a material selected from nitrogen, carbon dioxide, sulfur hexafluoride, fluorocarbon, and fluoro-chlorocarbon, or combination thereof.

3. A discharge lamp according to claim 1, wherein said inner tube is filled with mercury, tantalum halide and xenon as starting rare gas.

4. A discharge lamp according to claim 2, wherein said breakdown suppressing gas is contained in said mixture in an amount of 1–10 pressure percent.

5. A discharge lamp according to claim 1, said lamp being an ultraviolet ray discharge lamp.

6. A discharge lamp according to claim 1, wherein said outer tube is filled with neon gas only at a pressure of 0.1 atm or more.

7. A discharge lamp according to claim 6, wherein said pressure is 0.1–1 atm.

8. A discharge lamp according to claim 1, wherein said outer tube is filled with a gas mixture of neon in 80 pressure percent or more and a breakdown suppressing gas.

9. A discharge lamp according to claim 8, wherein said gas mixture is contained in the outer tube at a pressure of 0.1 atm or more.

10. A discharge lamp according to claim 9, wherein said pressure is 0.1–1 atm.

* * * * *